United States Patent [19]

Legille et al.

[11] 4,071,166

[45] Jan. 31, 1978

[54] BLAST FURNACE CHARGING METHOD AND APPARATUS

[75] Inventors: Edouard Legille, Luxembourg; Rene N. Mahr, Howald-Hesperange, both of Luxembourg

[73] Assignee: S.A. des Anciens Etablissements Paul Wurth, Luxembourg, Luxembourg

[21] Appl. No.: 339,297

[22] Filed: Mar. 6, 1973

[30] Foreign Application Priority Data

Aug. 11, 1972 Luxembourg ..... 66430

[51] Int. Cl.[2] ..... F27B 11/12

[52] U.S. Cl. ..... 222/1; 214/35 R; 222/58

[58] Field of Search ..... 222/558, 58, 56, 1; 214/35 R, 2, 17, 17 R, 17 CB

[56] References Cited

U.S. PATENT DOCUMENTS

| | | | |
|---|---|---|---|
| 3,217,927 | 11/1965 | Bale, Jr. et al. | 222/56 |
| 3,573,337 | 4/1971 | Grimm et al. | 214/35 R |

FOREIGN PATENT DOCUMENTS

| | | | |
|---|---|---|---|
| 684,672 | 4/1964 | Canada | 214/2 |
| 59,207 | 9/1969 | Luxembourg | 214/35 R |

*Primary Examiner*—Robert B. Reeves
*Assistant Examiner*—David A. Scherbel

[57] ABSTRACT

A method for the controlled delivery of ore charges to a shaft furnace is disclosed. The method employs apparatus including a plurality of sensors on which an intermediate charge storage hopper is supported whereby continuous measurement of charge weight is permitted. The apparatus also includes means for establishing hermetic coupling of the storage hopper to the furnace whereby compensation for temperature and pressure induced positional displacements and biasing of the sensors is permitted.

19 Claims, 2 Drawing Figures

56'
56
53'
53
71'
71
57'
57
69
72'
72
65
61
61'
58(59)
(59')58'
64
60
55
64'
66
65'
67
67
68
66
68'
54'
54
70'
70
54"
63
62
52
50
51

BLAST FURNACE CHARGING METHOD AND APPARATUS

BACKGROUND OF THE INVENTION

1. Field of the Invention

This invention relates to the charging of furnaces and particularly shaft furnaces. More specifically, the present invention is directed to a metering device which, in addition to enabling control of the flow of charge material being directed onto the hearth of a blast furnace, also permits the weight or volume of the charge to be accurately measured whereby the measured quantity may thereafter be employed to position the material flow control device. Accordingly, the general objects of the present invention are to provide novel and improved methods and apparatus of such character.

2. Description of the Prior Art

While not limited thereto in its utility, the present invention is particularly well suited for use with a blast furnace. The construction of modern high production blast furnaces has imposed new and more stringent demands on the charging apparatus due in part to the increased internal pressures employed within the furnace and the increased dimensions of the hearth within the furnace over which the charge must be uniformly distributed. In order to optimize furnace operation; i.e., to obtain the greatest possible pig iron production in a large high pressure furnace; it is necessary to be able to measure and exercise control over all of the operating processes both in and on the furnace. The distribution and metering of of the charge of ore over the furnace cross-section is a matter of primary importance because the profile of the charge provides the basis for the control of further operating processes within the furnace.

Among the problems which must be overcome in order to obtain the desired uniform operation of a blast furnace are those associated with the gassing of the charge material and the control of the distribution of the charge. A degree of success in avoiding disturbances to furnace operation by non-uniform gassing has been achieved through the expedient of pretreatment of all of the charge materials by grinding and screening to obtain a narrow grain size range and by sintering or pelletizing the material to achieve a charge which is as granular as possible. However, even with uniform grain size the requisite high pressure at the furnace throat can not be maintained without also taking into consideration the profile of the charge. In fact, it has been found that the importance of charge distribution control is directly related to the degree of classification of the charge material. Restated, experience has shown that efforts to perform the charging process in such a way that the desired furnace operating parameters are not jeopardized must increase as the uniformity of the charge material increases.

The conventional furnace charging units of the prior art included a lower bell-type distributor. Furnace charging was accomplished by first loading the bell-type distributor and thereafter lowering the distributor into the furnace. These bell-type distributor charging devices inherently could not achieve a uniform distribution of the charge over the complete charging plane. That is, efforts previously made to supply bell-type distributors with charge material in a uniform manner over their periphery have not prevented the formation of a hollow cone below the distributors. In other words, the well known characteristic M-curve of the charge surface can not be avoided by the uniform distribution of the charge on the periphery of a lower bell-type distributor. The use of adjustable throat armors can only partially alleviate the considerable disadvantage of non-uniform charge distribution in the case of blast furnaces with large hearth diameters.

U.S. Pat. No. 3,693,812 issued Sept. 26, 1972 to R. Mahr et al discloses apparatus which permits the optimal uniform distribution of a furnace charge over the entire charging area. The novel charging apparatus of U.S. Pat. No. 3,693,812 comprises a distributing member rotatably arranged in the throat of a shaft furnace and angularly adjustable relative to the longitudinal axis of the furnace. The adjustable distributing member or chute is supplied from a centrally arranged spout; the spout providing communication between the distributing member and one or more storage hoppers in which charges of the furnace raw materials are temporarily stored. In the prior art such storage hoppers have conventionally been in the form of sluice bins which deliver materials to the centrally arranged spout via metering devices such as discharge channels, throttle members, vibration zones, etc.

The metering devices of the prior art have only served to prevent the direct unimpeded out-flow of the charge material to the distributing member. Thus, the main characteristic of previously known metering devices, in addition to exercising a degree of metering action by influencing the material flow rate, is a braking action which insures that too rapid a feed rate is avoided while simultaneously insuring that there will be an adequate feed rate to provide sufficiently large forces to prevent a blockage of the charge in the region of the supply hopper outlet port. The prior art metering devices have not been capable of accurately measuring the charge in the interest of facilitating control of the charging operation.

SUMMARY OF THE INVENTION

The present invention overcomes the above briefly discussed and other deficiencies and disadvantages of the prior art by providing a charging central technique and system adapted to the demands of modern high output blast furnace operation. The present invention permits the accurate control and, if desired, automation of the introduction of high-grade charge material of varying compositions into a furnace. Thus, the present invention enables monitoring of the complete charging operation of a high pressure furnace and thereby permits satisfactory and random control of the charging process.

The above and other objects of the present invention are achieved by continuously measuring the charge in the storage hoppers from which a shaft furnace is supplied during the charging process. Also in accordance with the invention, the result of the measurement performed on the charge in a storage hopper may be employed to control a metering device positioned intermediate the outlet port of the hopper and a rotatable and angularly adjustable distributing member positioned in the furnace throat. In accordance with a further aspect of the invention, the distributing member may itself be controlled by a signal commensurate with the instantaneous charge weight or volume as provided as a result of the measurement of the charge in the storage hopper. Accordingly, a furnace charging process can be continuously controlled in accordance with the present invention and such control can be achieved in accordance with a predetermined program.

Pursuant to the present invention, each of the charge storage bins of a shaft furnace is in the form of a weighing hopper equipped with a measuring unit which is independent of the furnace pressure or other disturbing parameters. Accordingly, the measuring unit always provides an accurate indication of the weight of the material in the hopper. The out-flow channel of the weighing hoppers is closed by a throttle or flow control valve and the position of this valve may be controlled by a signal commensurate with instantaneous weight of the burden in the hopper. Accordingly, the charge or burden out-flow can be controlled in such a manner that a particular quantity of charge material is supplied to the distributing member in the furnace throat over a predetermined time. The distributing member is therefore, in accordance with the invention, advantageously in the form of an angularly adjustable revolving chute of the type disclosed in U.S. Pat. No. 3,693,812.

In accordance with a preferred embodiment of apparatus in accordance with the invention, each storage hopper is arranged in a substantially free-standing manner on a plurality of trackless load or pressure cells. The pressure cells are displaced relative to one another about the periphery of the hopper and support the hoppers above a framework which extends to the superstructure of the furnace. Means, preferably in the form of a segmented central distribution spout which includes an intermediate compensator, are provided to compensate for vertical dimensional displacements induced during furnace operation. Means are also provided which permits the biasing of the load cells associated with each hopper into their linear positive measuring range thereby compensating for forces induced by the pressure established in a hopper during and immediately after a charging operation.

BRIEF DESCRIPTION OF THE DRAWING

The present invention may be better understood and its numerous objects and advantages will become apparent by reference to the accompanying drawing wherein like reference numerals refer to like elements in the figures and in which.

DESCRIPTION OF THE PREFERRED EMBODIMENT

Figure 1:
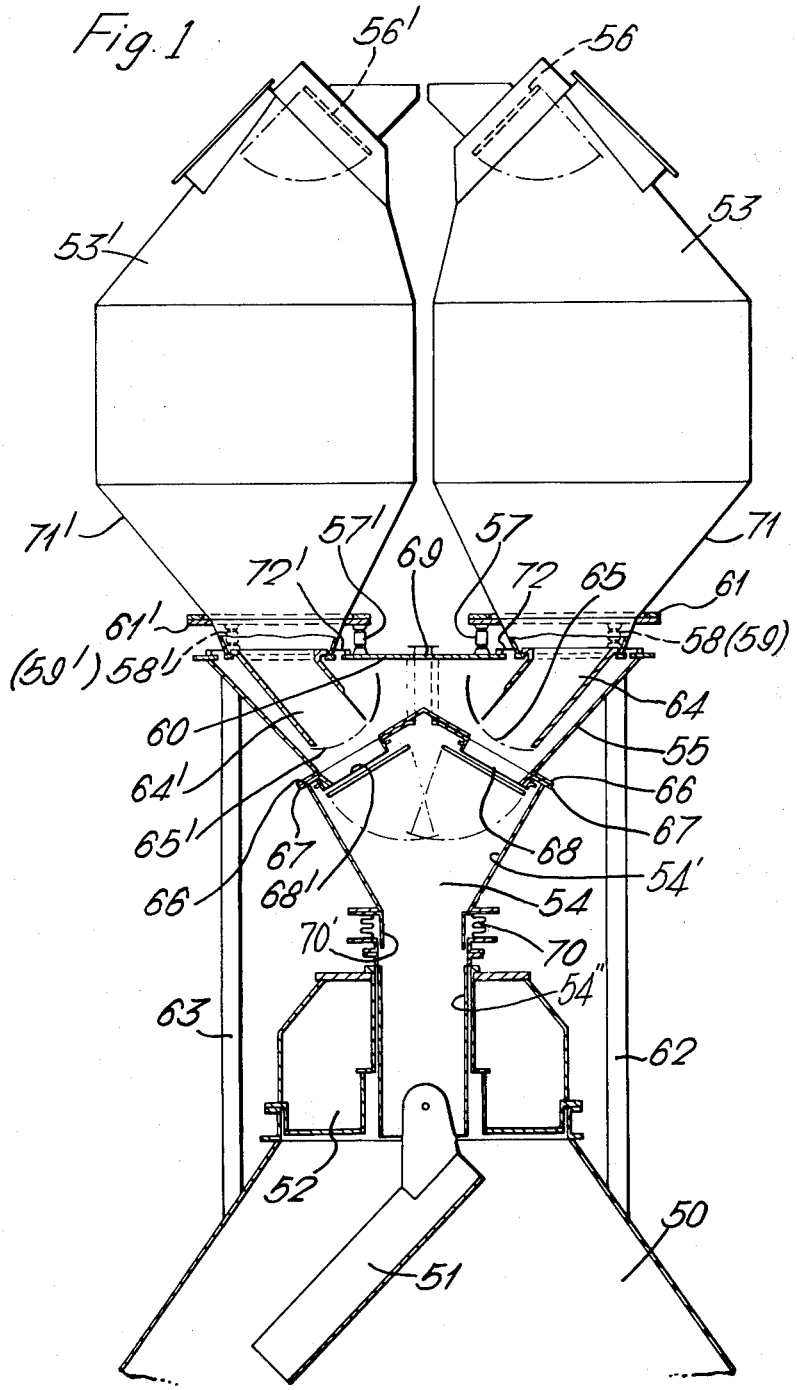
FIG. 1 is a longitudinal section through a schematic representation of a furnace charging system in accordance with the present invention.

As previously noted, the present invention contemplates a bell-less distributor for use in the charging of a shaft furnace. Thus, in accordance with the invention, an angularly adjustable rotary distribution chute 51 is mounted within the throat or head 1 of a blast furnace. Chute 51, which is angularly adjustable relative to the vertical axis of the furnace, is supplied with raw material from a centrally arranged feed spout assembly 54 during the charging process. The drive means for controlling the rotation and pitch angle adjustment of distribution chute 51 is positioned within a drive chamber 52.

The feed spout assembly 54 provides, in the manner to be described below, communication between chute 51 and one or more storage hoppers. In the disclosed embodiment a pair of storage hoppers 53, 53' are employed and the charge material or furnace burden is fed to the hoppers via skips or a conveyor belt installation, not shown.

The storage hoppers 53, 53' are constructed as pressure hoppers in order to insure that the furnace throat 1 is sealed to the atmosphere during the charging process. Thus, the charging hoppers 53, 53' are provided respectively with upper sealing valves 56 and 56'. Lower sealing valves 68 and 68' are, as will be described below, respectively operatively associated with hoppers 53 and 53'. The valves 56 and 68 are, in the manner well known in the art, opened singly to permit the sequence of loading the hoppers and the subsequent charging of the furnace; the valves being opened or closed at the charging rate whereby pressure compensation within the hoppers is performed in the well known manner.

The charge hoppers 53 and 53' are each supported on three measuring pressure or load cells; cells 57, 58 and 59 being associated with hopper 53 and cells 57', 58' and 59' being associated with hopper 53'. The load cells which support each storage hopper are displaced relative to one another by 120° and arranged in a circle about the hopper. The load cells are mounted on upper sealing plate 60 of a connecting casing 55; the connecting casing 55 providing communication between the discharge ports of the storage hoppers and the feed spout 54. Storage hoppers 53 and 53' respectively have support rings 61 and 61' mounted on their exteriors. The support rings 61 and 61' provide a projecting surface for engagement by the load cells.

The charging system is mounted from the furnace by means of a plurality of vertical support members, such as beams 62 and 63, which extend between the exterior of the furnace throat portion 50 and the underside of the upper sealing plate 60 of the connecting casing 55.

Discharge channels 64 and 64', respectively of storage hoppers 53 and 53', project downwardly at an angle through apertures provided therefore in the upper sealing plate 60 of connecting casing 55. The discharge channels 64 and 64' are preferably provided, at their lower ends, with metering devices indicated schematically at 65 and 65'. These metering devices, or throttle valves, may take the form of the flow control valves described in detail in copending application Ser. No. 339,296 filed contemporaneously herewith and incorporated herein by reference; copending application Ser. No. 339,296 being assigned to the assignee of the present invention. Since the discharge channels 64, 64' are affixed to respective storage hoppers 53 and 53' and do not come into contact with the connecting casing 55, only the drive shafts for control valves 65 and 65' need pass through connecting casing 55. In order to prevent possible displacements between the discharge channels 64 and 64' and their respective control valves 65 and 65', the drive means for the control valves will preferably be mounted on the outer casing of the hoppers 53 and 53'. The means which permits passage of the drive shafts for the flow control valves 65, 65' through connecting casing 55 will insure a gas-tight seal while simultaneously permitting a limited degree of movement of the drive shafts relative to casing 55.

The feed spout assembly 54 is mounted from the underside of a lower sealing plate 66; sealing plate 66 being of conical shape and forming the lower end of the connecting casing 55. The connection between lower sealing plate 66 and the feed spout assembly 54 is accomplished by means of a flange 67 at the upper end of the feed spout; the flange 67 and the lower sealing plate 66 being provided with apertures which are in registration and which permit the flow of the charge material from the storage hoppers to the feed spout via the discharge channels 64, 64' of the hoppers. As noted above, the recesses in the flange 67 of the feed spout assembly 54 are provided with lower sealing valves 68, 68'. The lower sealing valves, in the closed state, seal the counter-pressure at the furnace throat relative to the storage hoppers 53, 53'. In the open state valves 68 and 68' are completely removed from the material flow path so that they are not contacted thereby and the life of their sealing surface is thus enhanced. Means in the form of sheet steel partitions, not shown, are provided inside connecting casing 55 to divide the casing into hermetic compartments associated with each of the discharge channels 64 and 64'. A centrally positioned assembly pipe 69 passes through connecting casing 55 in the vertical direction and permits visual inspection of the distribution chute 51 and the insertion of suitable auxiliary devices and tools which permit the maintenance of the distribution chute. During normal operation the pipe 69 is hermetically sealed by means of a sealing flange.

In view of the high temperatures and pressures encountered during operation of the furnace, means must be provided to compensate for vertical differential displacements which are induced in the components positioned below the upper sealing plate 60 of casing 55. Accordingly, a corrugated compensator 70 is provided for coupling the funnel and vertically rising portions of feed spout assembly 54 to one another. As shown in FIG. 1, the funnel portion 54' of the central feed spout is provided with a lower flange while the vertically rising portion 54" of the feed spout is provided with a facing upper flange. The corrugated compensator 70 extends between the oppositely disposed flanges at the ends of portions 54' and 54" of the central feed spout and provides an expandable hermetic seal. A shield 70' is provided internally of the feed spout to protect the compensator 70 from impingement by the flowing furnace burden during a charging operation; member 70 being affixed to the funnel portion 54' of the feed spout and moving therewith relative to an upper extension of portion 54" of the spout in telescoping fashion.

The connecting casing 55 is designed to be as rigid as possible in the interest of insuring that a loaded one of the storage hoppers 53, 53' will not influence the load cells which support the other hopper. Restated, the resistance of connecting casing 55 to deformation forces which occur must be sufficiently large to provide a residual reference plane for the measuring cells 57, 58, 59, 57', 58' and 59'.

Figure 2:
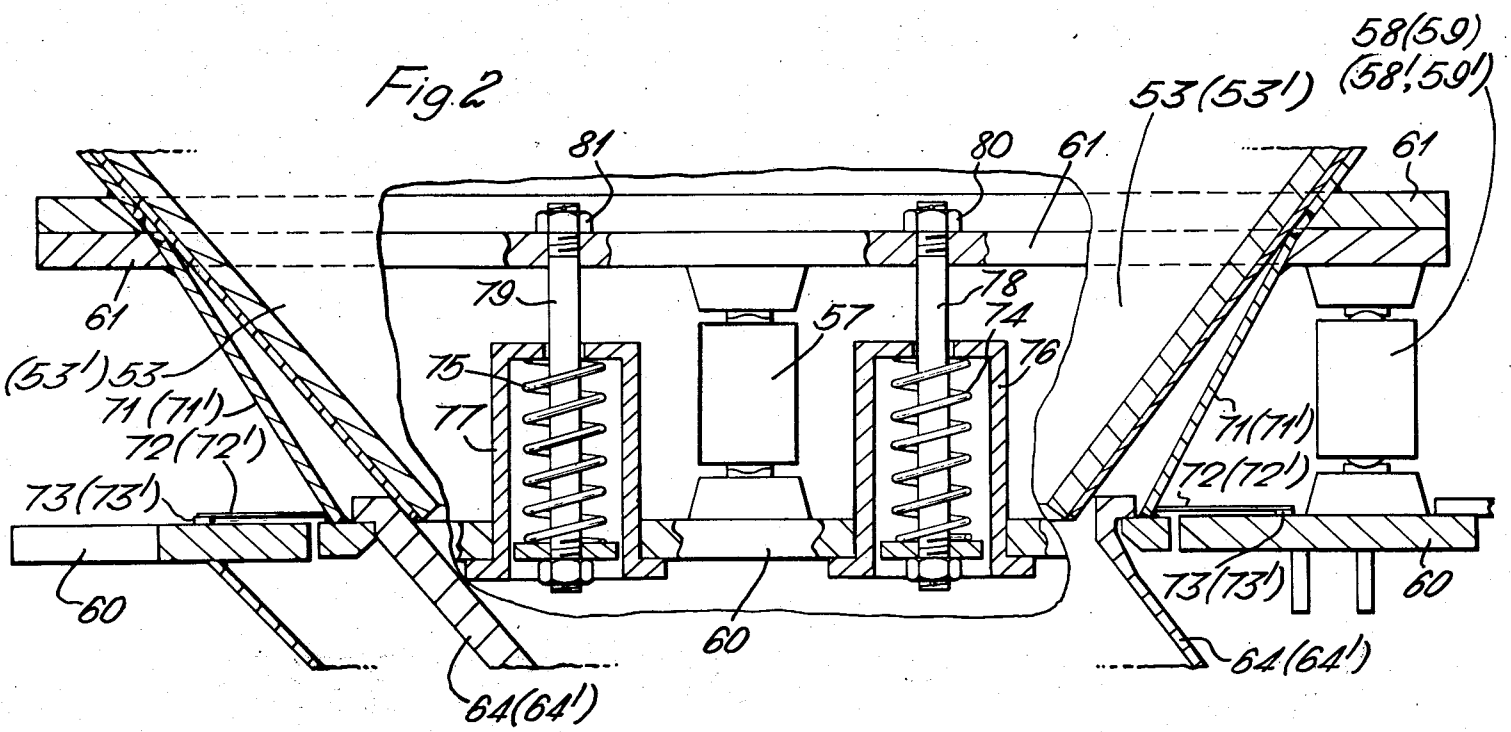
FIG. 2 is an enlarged view depicting one of the charge weight measuring devices associated with one of the supply hoppers of the FIG. 1 embodiment.

Referring now to FIG. 2, means are shown which provide the necessary support for storage hoppers 53, 53' in the horizontal direction. A retaining ring 72 is provided about the outer casing 71 of each hopper 53. The retaining rings are positioned above the upper sealing plate 60 completely about the periphery of the storage hoppers. The retaining ring 72 comprises a thin steel sheet which is welded to outer casing 71 of hopper 53. The ring 72 is welded, about its outer edge, to the upper side of the upper sealing plate 60 via an intermediate spacer member. Since it must perform both sealing and dimensional compensating functions, the ring 72 must be spacially displaced from the surface of the sealing plate 60 as shown; the spacing being defined by the intermediate support ring 73. Accordingly, the ring 72 is capable of a limited degree of flexural movement which facilitates compensation of the adjustment path of the load cells.

FIG. 2 also shows the means by which the load cells may be prestressed in accordance with the invention; FIG. 2 showing the adjustment mechanism for load cell 57 only. The load cell 57 is subject to compression forces generated by a pair of spiral springs 74 and 75. Springs 74 and 75 are mounted in respective housings or bushings 76 and 77 which engage the lower surface of upper sealing plate 60. Adjustment bolts 78 and 79 pass through respective spiral springs 74 and 75 and engage at their upper ends, support ring 61 by means of adjustment nuts 80 and 81. Nuts 80 and 81 serve for metering the prestressing force on load cell 57 and can be secured against unintentional movement during operation by any known means.

To summarize the invention, each of the storage hoppers 53, 53' has either an outwardly directed flange or three individual supports adjacent its lower end. The flange or supports are coupled to and supported by individual load or pressure cells which are provided on the top of the retaining frame for the storage hoppers. The upper support plate of the frame thus defines a fixed or reference point or plane for the measuring cells. The upper support plate is provided with openings and the discharge channels affixed to the discharge openings of the storage hoppers will project through these openings. The apparatus is designed to provide sufficient clearance to insure that there is no direction contact between the storage hopper discharge channels and the upper support plate. However, in order to provide adequate support in the horizontal direction for the storage hoppers, each hopper is provided with a thin sheet steel ring positioned above and welded to both the exterior of the hopper and the top surface of the support plate. A spacer is provided between the thin steel ring and the upper support plate thereby permitting limited displacement of the hopper. The steel ring thus performs the functions of hermetically sealing the hoppers to the furnace throat, supporting the hopper in the horizontal direction and providing compensation.

The upper support plate is rigidly connected to the exterior of the blast furnace, for example by a plurality of vertically extending beams, and forms part of a connecting casing 55 which encloses the discharge channels of the supply hoppers. The connecting casing is affixed, in a gas-tight manner, to the underside of the upper support plate at its upper end. At the end facing the furnace the connecting casing is provided with a conically upwardly directed closure plate. The connecting casing is hermetically coupled to the closure plate and the closure plate is in turn hermetically coupled to the upper end of the centrally arranged feed spout assembly 54. The lower closure plate of the connecting casing is provided with ports or openings which register with entrance ports to the central spout whereby the flow path for charge material may be established from a hopper to the feed spout via a hopper discharge channel. The connecting casing is divided into hermetically sealed compartments associated with each storage hopper.

Sealing valves are provided which cooperate with the openings in the plate which defines the upper end of the central feed spout. These sealing valves, in the closed condition, isolate their associated storage hopper from the high pressure, high temperature blast furnace gases. In the open state the sealing valves are withdrawn completely from the charge material flow path in order to protect the relatively soft material which defines the sealing surfaces from erosion by flowing charge material. The thin sheet steel ring 72 insures that there will be no leakage of blast furnace gases to the ambient atmosphere when a lower sealing valve is open.

The charging installation in accordance with the present invention is characterized by sufficient rigidity to absorb all external deformation forces such as, for example, caused by the weight of the loaded storage hoppers. Such a rigid construction is necessary because the storage hoppers are supported only on their periphery and hopper-to-hopper support is not provided.

A corrugated compensator 70 is provided for coupling together two portions of the central feed spout assembly in the interest of absorbing thermally and pressure induced expansion and contraction of the elements of the feed system and of components of the superstructure of the blast furnace head.

As noted, a further compensation function is performed by the thin steel ring attached to the lower end of each storage hopper. The flexibility of this ring permits adjustment or compensation of the load cells which support the storage hoppers; the maximum adjustment path of the load cells typically being about 0.1 mm. The flexible metal ring will be sufficiently elastic so as to maintain its powers for resistance relative to the storage hopper weight as small as possible.

The furnace charge weight measuring installation in accordance with the present invention may operate in a number of different modes. After each charging process a storage hopper will be ready to receive a new charge from the main ore pit. To permit charging, the lower sealing valve is closed and the upper sealing valve subsequently opened. With the storage hopper at ambient or atmospheric pressure the charge material is brought from the material pit to the hopper via a skip or conveyor belt installation. At the end of the filling process the measuring device, after deducting the dead weight of the hopper, indicates the weight of the charge in the storage hopper. This weight indication may be stored in an appropriate device. The weight indication retention function is simplified if electrical signals produced by the trackless load cells are used directly for data storage. With the weighing function complete, the upper sealing valve is closed and the storage hopper internal pressure equalized, in the manner known in the art, with blast furnace pressure.

As the storage hopper internal pressure approaches blast furnace internal pressure, pressure compensation forces can occur which counter the weight of the storage hopper and thereby attempt to "raise" the hopper from the measuring cells. Thus, by way of example, a reaction force will be generated in the hopper because the hopper itself is not designed as a closed vessel but is connected with a closed area via its discharge channel. Consequently, the position of the measuring cells after pressure compensation will not provide a signal commensurate with the true weight of the charge in the hopper. However, since the initial weight of the charge has been sensed and stored prior to pressure compensation, electronic compensation for the counter-forces which result because of the pressure can be performed.

It is to be noted that the reaction forces produced may, depending on the size of the discharge channel and the magnitude of the furnace throat pressure, be so significant that the load cells will operate in their negative zone with an empty hopper. Typical commercially available measuring cells are incapable of detection of the passage between the positive to negative measuring ranges. Thus, in accordance with the present invention, the measuring cells may be biased so that they exclusively and preferably work in their linear positive measuring ranges. The biasing of the measuring cells is achieved mechanically by means of the adjustable spiral spring arrangement of FIG. 2. The spiral springs are located at the same level and in close proximity to the measuring cells and urge the storage hopper onto the cells with a certain fixed biasing force. In the preferred embodiment each measuring cell is surrounded by a pair of spiral springs which are under tension and which link the hopper with the supporting framework. The biasing of the load cells into their linear positive measuring range also facilitates automatic detection of an empty hopper thereby enhancing the entire efficiency of furnace operation by permitting immediate reloading of an empty hopper.

In accordance with a preferable mode of operation of the disclosed embodiment of the invention, it is desired to achieve an approximately constant material feed flow rate during the charging process. Such a constant feed rate coupled with proper control of the distribution chute 51 will result in a uniform charge height across the entire furnace hearth. The material supply per time unit is determined as a function of the initial weight of the charge in the supply hoppers and the time necessary for the distribution chute 51 to describe a complete charging configuration. The medium initial position of each throttle valve 65 is adjusted on the basis of experimental values and is primarily dependent on the grain size of the charge material. During discharge of the material from the supply hopper the throttle valve position is corrected relative to the medium initial value. Another possibility for exercising control over the material discharge rate from the storage hoppers 53 and 53' contemplates supplying data commensurate with the predetermined desired material flow rate to a computer and to compare the same with the values which actually occur during a charging process, as provided by monitoring the rate of change of the supply hopper weight, and to then perform the correction determined by the computer during subsequent charging operations.

As an alternative to the above described charging procedures, control based upon the weight measurement may be exercised over the distributing chute 51. Thus, by way of example, the material feed to chute 51 can be effected either discontinuously or continuously with different feed quantities per time unit in accordance with a predetermined curve. Under such circumstances the signals provided by the weight measurement can be employed, after suitable processing, to control the movements of chute 51 to vary both the rotational speed and the angular position of the chute.

While a preferred embodiment has been shown and described various modifications and substitutions may be made thereto without departing from the spirit and scope of the invention. Accordingly, it is to be understood that the present invention has been described by way of illustration and not limitation.

What is claimed is:

1. Apparatus for use in the delivery of materials to the interior of a shaft furnace, said furnace having a vertical axis and operating with a high counter-pressure, said furnace further having a feed spout, said apparatus comprising:

at least one storage hopper for providing intermediate storage for a charge material to be delivered to the furnace, said storage hopper having a supply port and a discharge port;

frame means affixed to the furnace;

weighing means supporting said storage hopper from said frame means, said weighing means including a plurality of sensors displaced about the periphery of said storage hopper with respect to one another;

means for delivering material from said storage hopper to the furnace feed spout, said delivery means including a flow control metering valve, said delivery means being supported on the furnace;

compensating means hermetically coupling the exterior of said storage hopper to the exterior of the furnace, said compensating means being characterized by sufficient flexibility to absorb vertical dimensional changes of said furnace resulting from operating conditions while maintaining the hermeticity of the coupling; and means for biasing said sensors to compensate for forces applied to said storage hopper as a result of furnace operating conditions other than the gravitational force representing the quantity of material in said storage hopper.

2. The apparatus of claim 1 wherein said delivery means has an outer casing and wherein compensating means comprises:

first flexible means connecting said delivery means outer casing to the exterior of said storage hopper; and second flexible means connecting said delivery means outer casing to the furnace.

3. The apparatus of claim 2 wherein said first flexible means comprises:

a retaining ring affixed to the exterior of said storage hopper; and a flexible metallic member connecting said retaining ring to said delivery means outer casing.

4. The apparatus of claim 3 further comprising:

rotary and angularly adjustable charge distributing means positioned in the furnace, said distributing means receiving material from the furnace feed spout.

5. The apparatus of claim 4 wherein said sensors each comprise:

a load cell.

6. The apparatus of claim 5 wherein said biasing means comprises:

means for imposing a load on each of the load cells to insure operation thereof in the positive range.

7. The apparatus of claim 6 wherein said means for imposing a load on each of the load cells comprises:

a pair of helical springs coupled to the load cell, said springs being in compression; and means for adjusting the tension of each of said springs.

8. The apparatus of claim 1 further comprising:

rotary and angularly adjustable charge distributing means positioned in the furnace, said distributing means receiving material from the furnace feed spout.

9. Apparatus for the delivery of materials to a shaft furnace comprising:

at least a first storage hopper for providing intermediate storage for a charge of materials to be delivered to a furnace, said storage hopper having a supply port and a discharge port;

frame means affixed to the furnace;

weight measuring means supporting said first storage hopper from said frame means, said weight measuring means including a plurality of weighing devices displaced about the periphery of said storage hopper with respect to one another;

a tubular feed spout, said feed spout having a cylindrical shape and being connected at its first end to the furnace;

a conical flow directing member;

an expandable compensating member hermetically coupling the second end of said feed spout to the smaller diameter end of said conical member;

a retaining ring affixed to the exterior of said storage hopper about the discharge port therein;

discharge channel housing means, said channel housing means connected at a first end to said conical member adjacent the larger diameter end thereof;

a metering valve positioned in said discharge channel housing means for controlling the flow of material from said storage hopper to said feed spout second end; and means hermetically connecting said retaining ring to said housing means adjacent a second end thereof.

10. The apparatus of claim 9 wherein said means connecting said retaining ring to said discharge channel housing means comprises:

a flexible metallic member.

11. The apparatus of claim 9 further comprising:

rotary and angularly adjustable charge distributing means positioned in said furnace, said distributing means receiving material from said feed spout.

12. The apparatus of claim 11 wherein said means connecting said retaining ring to said discharge channel housing means comprises:

a flexible metallic member.

13. The apparatus of claim 9 wherein said measuring means each weighing device comprise:

a load cell.

14. The apparatus of claim 13 further comprising:

means for biasing said load cells to insure operation thereof in the positive range.

15. Apparatus for the delivery of materials to a shaft furnace comprising:

at least a first storage hopper for providing intermediate storage for a charge of materials to be delivered to a furnace, said storage hopper having a supply port and a discharge port;

frame means affixed to the furnace;

weight measuring means supporting said first storage hopper from said frame means, said weight measuring means including a plurality of load cells displaced about the periphery of said storage hopper with respect to one another;

longitudinally expandable feed spout means, said feed spout means communicating at a first end with said furnace;

discharge channel housing means connected at a first end to said feed spout means second end;

a retaining ring affixed to the exterior of said storage hopper about the discharge port therein;

means hermetically connecting said retaining ring to the second end of said discharge channel housing means;

a metering valve positioned in said discharge channel housing means for controlling the flow of material to said feed spout second end; and means for biasing said weight measuring means load cells to insure operation thereof in the positive range, said biasing means each comprising:

a pair of helical springs coupled to the load cell, said springs being in compression; and means for adjusting the tension of each of said springs.

16. The apparatus of claim 15 wherein said means connecting said retaining ring to said discharge channel housing means comprises:

a flexible metallic member.

17. The apparatus of claim 16 wherein said longitudinally expandable spout means comprises:

a conical member connected at its larger diameter end to said discharge channel housing means;

a cylindrical member connected at its first end to the furnace; and an expandable compensating member hermetically coupling the second ends of said conical and cylindrical members.

18. The apparatus of claim 17 further comprising:

rotary and angularly adjustable charge distributing means positioned in said furnace, said distributing means receiving material from said spout means conical member.

19. The method of supplying charge material to a shaft furnace, the furnace being provided with at least one intermediate storage hopper for storing a charge of material to be fed to the furnace and a distributing device disposed in the furnace so as to be supplied from the storage hopper, the method comprising the steps of:

loading the storage hopper with charge material, the hopper being at atmospheric pressure and being isolated from the interior of the furnace during loading;

sealing the interior of the hopper from the ambient atmosphere;

pressurizing the hopper to the pressure level existing in the furnace;

discharging the charge material from the hopper subsequent to pressurization thereof;

measuring the quantity of material in the hopper during the discharge thereof;

exercising control over the delivery to the furnace interior of charge materials being discharged from the hopper as a function of the instantaneous quantity of material in the hopper as obtained from the measuring thereof;

providing force compensation during charging and discharging of the hopper whereby the quantity measurement will not be adversely affected by the furnace operating conditions; and maintaining a flexible hermetic seal between the exterior of the hopper and the exterior of the furnace to compensate for relative displacements of the hopper and furnace resulting from furnace operating conditions.

* * * * *